US008591819B2

(12) United States Patent
Kawamura et al.

(10) Patent No.: US 8,591,819 B2
(45) Date of Patent: Nov. 26, 2013

(54) COMBUSTION-TYPE EXHAUST GAS TREATMENT APPARATUS

(75) Inventors: Kotaro Kawamura, Tokyo (JP); Hiroyuki Arai, Tokyo (JP); Yasutaka Muroga, Tokyo (JP)

(73) Assignee: Ebara Corporation, Tokyo (JP)

( * ) Notice: Subject to any disclaimer, the term of this patent is extended or adjusted under 35 U.S.C. 154(b) by 1039 days.

(21) Appl. No.: 11/987,764

(22) Filed: Dec. 4, 2007

(65) Prior Publication Data

US 2008/0131334 A1 Jun. 5, 2008

(30) Foreign Application Priority Data

Dec. 5, 2006 (JP) ..... 2006-328248
Nov. 15, 2007 (JP) ..... 2007-296395

(51) Int. Cl.
*B01D 50/00* (2006.01)

(52) U.S. Cl.
USPC ..... 422/168; 422/169

(58) Field of Classification Search
USPC ..... 422/168, 177, 180
See application file for complete search history.

(56) References Cited

U.S. PATENT DOCUMENTS

| | | | | |
|---|---|---|---|---|
| 5,123,836 | A | 6/1992 | Yoneda et al. | |
| 5,510,093 | A * | 4/1996 | Bartz et al. | 423/240 R |
| 5,591,415 | A * | 1/1997 | Dassel et al. | 422/241 |
| 5,693,293 | A | 12/1997 | Reichardt et al. | |
| 5,833,888 | A * | 11/1998 | Arya et al. | 261/112.1 |
| 6,322,756 | B1 * | 11/2001 | Arno et al. | 422/171 |
| 6,333,010 | B1 * | 12/2001 | Holst et al. | 422/171 |
| 6,494,711 | B1 | 12/2002 | Takemura et al. | |
| 2005/0064353 | A1 | 3/2005 | Wiesenberg et al. | |
| 2005/0135984 | A1 | 6/2005 | Ferron et al. | |
| 2006/0104879 | A1 * | 5/2006 | Chiu et al. | 423/245.3 |
| 2008/0095675 | A1 * | 4/2008 | Hartung | 422/171 |

FOREIGN PATENT DOCUMENTS

| | | | |
|---|---|---|---|
| CN | 101031349 | | 9/2007 |
| DE | 10 2004 047 440 | | 4/2006 |
| EP | 916388 | A2 * | 5/1999 |
| EP | 1 517 083 | | 3/2005 |
| JP | 8-511615 | | 12/1996 |
| JP | 2005-83745 | | 3/2005 |
| KR | 10-0312009 | | 6/2002 |
| WO | 2006/034684 | | 4/2006 |

OTHER PUBLICATIONS

Extended European Search Report issued Jun. 14, 2013 in corresponding European Patent Application No. 07023594.0.

* cited by examiner

*Primary Examiner* — Tom Duong
(74) *Attorney, Agent, or Firm* — Wenderoth, Lind & Ponack, L.L.P.

(57) ABSTRACT

A combustion-type exhaust gas treatment apparatus is used to treat a harmful exhaust gas by combustion to render the gas harmless. The treatment apparatus includes a combustion treatment section, a cooling section, and a washing section. The combustion treatment section includes an exhaust-gas treatment combustor, a body made from metal and having a roughened inner surface, and a water-film formation mechanism adapted to form a water film on the inner surface of the body. The combustion treatment of the exhaust gas is performed in the body.

17 Claims, 16 Drawing Sheets

COMBUSTION-TYPE EXHAUST GAS TREATMENT APPARATUS

BACKGROUND OF THE INVENTION

1. Field of the Invention

The present invention relates to a combustion-type exhaust gas treatment apparatus for treating a harmful and combustible exhaust gas, which contains, for example, silane gas ($SiH_4$) or halogen gas ($NF_3$, $ClF_3$, $SF_6$, $CHF_3$, $C_2F_6$, $CF_4$, or the like), by combustion so as to render the exhaust gas harmless.

2. Description of the Related Art

A semiconductor fabrication apparatus discharges a gas including a harmful and combustible exhaust gas, e.g., silane gas ($SiH_4$) or halogen gas ($NF_3$, $ClF_3$, $SF_6$, $CHF_3$, $C_2F_6$, $CF_4$). Such an exhaust gas cannot be released as it is into the atmosphere. Thus, the exhaust gas is generally introduced to a treatment apparatus, where the exhaust gas is oxidized by combustion so as to be rendered harmless. A widely-used treatment process of this type is such that a combustion-supporting gas is used to form flames in a furnace in which the exhaust gas is combusted by the flames, as seen in Japanese laid-open patent publication No. 11-218317.

A combustion-type exhaust gas treatment apparatus for use in a semiconductor industry and a liquid crystal industry potentially discharges a large amount of dust (mainly $SiO_2$) and a large amount of an acid gas as by-products of combustion treatment of the exhaust gas. Consequently, a regular maintenance operation is required so as to remove the dust from a treatment section, or an additional mechanism, such as a scraper, is required so as to regularly scrape away the dust attached to and deposited on an inner surface of a cylindrical body of a combustion treatment chamber.

The dust attached and deposited is composed mainly of $SiO_2$ (i.e., silicon dioxide). Other than $SiO_2$, however, the dust may probably have toxic dust mixed therewith. The dust has various diameters ranging from 0.1 micrometers to several tens of micrometers. Moreover, the dust may exist as large blocks. Consequently, it is necessary to ensure operational safety of the dust-removal maintenance so as not to cause health damage from suction of the dust.

In the case of providing the scraping mechanism, the number of components is increased. As a result, a manufacturing cost of products would be increased, and replacement of the scraping mechanism would be regularly required, thus increasing a running cost.

Because a temperature of a combustion gas in the combustion treatment chamber is as high as about 1700° C., a heat-resisting material, such as alumina-base glass ceramic, is used for the cylindrical body that surrounds the combustion treatment chamber. However, the temperature of the combustion treatment chamber is high, and if a fluorine or chlorine gas exists, the inner surface of the cylindrical body would be corroded and wasted. Therefore, it is necessary to regularly replace the cylindrical body. Such replacement of the high-priced cylindrical body incurs a cost and requires time-consuming maintenance.

SUMMARY OF THE INVENTION

The present invention has been made in view of the above drawbacks. It is therefore an object of the present invention to provide a combustion-type exhaust gas treatment apparatus which can use a low-priced material for a body that surrounds a combustion treatment chamber, can prevent the attachment of dust to an inner surface of the combustion treatment chamber, can prevent damage from a corrosive gas to the inner surface of the combustion treatment chamber, and can reduce time-consuming maintenance and maintenance costs.

A combustion-type exhaust gas treatment apparatus according to the present invention includes a combustion treatment section for performing combustion treatment on an exhaust gas, a cooling section for cooling the exhaust gas which has been treated in the combustion treatment section, and a washing section for washing the exhaust gas with water so as to remove by-products produced by the combustion treatment. The combustion treatment section includes an exhaust-gas treatment combustor, a body made from metal and having a roughened inner surface, and a water-film formation mechanism adapted to form a water film on the inner surface of the body. The combustion treatment of the exhaust gas is performed in the body.

As described above, the present invention provides the combustion-type exhaust gas treatment apparatus including the metal body with the roughened inner surface, so that the exhaust gas is treated by combustion in the body. The water film, which is formed on the inner surface of the body, provides a water-resisting structure. Therefore, a low-priced material, such as stainless steel, can be used to form the body. Moreover, the water film, which is formed on the inner surface of the body, can wash away the dust to thereby prevent the dust from adhering to the inner surface of the body. Furthermore, the water film can wash away the corrosive gas, and therefore the inner surface of the body is not damaged. As a result, a low-priced material, such as stainless steel, can be used to form the body, thus lowering the manufacturing cost of the body itself. In addition, time-consuming maintenance and maintenance costs can be reduced.

DETAILED DESCRIPTION OF THE INVENTION

Figure 1:
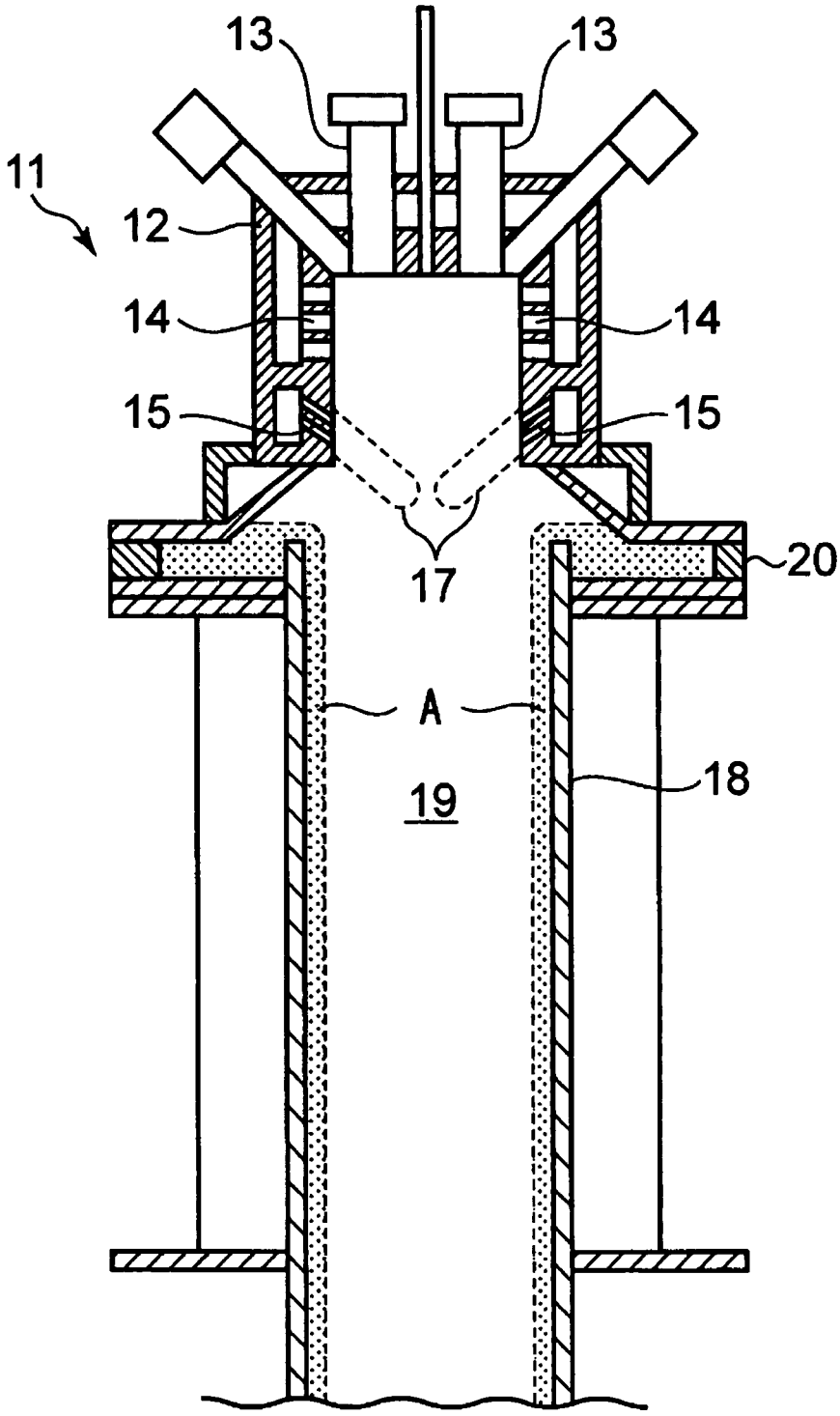
FIG. 1 is a cross-sectional view showing a combustion treatment section according to an embodiment of the present invention.

Embodiments of the present invention will be described below with reference to the drawings. In the drawings, components or elements having the same function or structure are denoted by the same reference numerals.

FIG. 1 is a cross-sectional view showing a combustion treatment section of a combustion-type exhaust gas treatment apparatus according to an embodiment of the present invention. The combustion treatment section 11 comprises an exhaust-gas treatment combustor 12. An exhaust gas is supplied through nozzles 13, and is then mixed with swirling flows of air supplied through air nozzles 14 and with a combustion-supporting gas supplied through combustion-supporting-gas nozzles 15. The mixture is combusted to thereby form flames 17. A combustion treatment chamber (flame holding chamber) 19, which is surrounded by a cylindrical body 18, is provided downstream of the flames 17. Combustion and treatment of the exhaust gas progress in this combustion treatment chamber 19. A water-flow flange 20 is provided between the exhaust-gas treatment combustor 12 and the cylindrical body 18, so that water flows down along an inner surface of the cylindrical body 18, thereby forming a water film A on the inner surface of the cylindrical body 18.

In this embodiment, stainless steel is used to form the cylindrical body 18. The inner surface of this cylindrical body 18 comprises a roughened surface. Since the inner surface of the cylindrical body 18 is roughened, a wettability of the inner surface is improved, and thus a uniform water film can be formed on the inner surface in its entirety. If a stainless steel, which is a hydrophobic material, has a mirror-finished inner surface, water droplets are likely to be formed thereon. Accordingly, it is difficult to form a uniform water film on the inner surface in its entirety. Because the inner surface of the cylindrical body 18 is roughened in its entirety, the stable water film can be formed on the inner surface in its entirety of the cylindrical body 18 with no water break.

The roughened surface can be formed by blasting, which is a method of forming a rough surface with a desired roughness by ejecting abrasives (e.g., sands or glass beads) at high speed to a surface using a compressed air or centrifugal force. The roughened surface may be formed by machining, such as cutting (broaching) which uses multiple blades or a spline method which scrapes a workpiece by a combination of a vertically-linear motion of a tool and a feed motion of the workpiece. Alternatively, the roughened surface may be formed by surface treatment, such as pickling or hydrophilic coating. Pickling is conducted by immersing a workpiece in a chemical liquid (e.g., nitric acid, hydrofluoric acid, hydrochloric acid, sulfuric acid), removing the workpiece from the chemical liquid, washing the workpiece with water, and drying the workpiece. Hydrophilic coating is conducted by coating an inner surface with a hydrophilic film, such as glass fiber, silicon polymer, or Teflon (registered trademark).

A preferable temperature for decomposition of the exhaust gas is at least 1700° C. Therefore, a temperature in the combustion treatment chamber 19 is kept at around 1700° C. An amount of water supplied from the water-flow flange 20 is adjusted such that the water film A has a thickness of at least 2 mm. The water film A with a thickness of at least 2 mm can provide a heat-resisting structure, whereby the temperature of the cylindrical body 18 is kept at substantially an ordinary temperature (not more than 50° C.). Therefore, a low-priced material, such as stainless steel, can be used for the cylindrical body 18, instead of the high-priced alumina-base glass ceramic. When the temperature of the water in the water-flow flange 20 is 30° C., the temperature of the water at an outlet of the cylindrical body 18 can be at several tens of degrees or less.

When dust, which has been produced in the combustion treatment chamber 19, approaches the inner surface of the cylindrical body 18, the water film A washes away the dust, thereby preventing the dust from adhering to the inner surface of the cylindrical body 18. Similarly, when molecules of a corrosive gas approach the inner surface of the cylindrical body 18, the water film A washes away the molecules of the corrosive gas. For example, when a fluorine by-product is produced in the combustion treatment, such a fluorine by-product becomes a thin hydrofluoric acid, which does not cause damage to the inner surface of the cylindrical body 18. Therefore, even if a low-priced material, such as stainless steel, is used for the cylindrical body 18, the dust does not adhere to the inner surface, and the inner surface is not corroded by the oxidizing gas. As a result, time-consuming maintenance and maintenance costs can be greatly reduced.

In FIG. 1, the inner surface of the cylindrical body 18 has a cylindrical shape with an inside diameter being constant from an upper end to a lower end of the cylindrical body 18. Alternatively, the inner surface of the cylindrical body 18 may have a conical shape with an inside diameter being gradually reduced in size from an upper end to a lower end of the cylindrical body 18. The cylindrical shape has advantages of eliminating a welded portion from the combustion treatment chamber to thereby avoid the water break, and simplifying the production of the cylindrical body to thereby reduce the manufacturing cost. The conical shape has an advantage in that the water film is easily formed because of its tapered shape. On the other hand, the conical shape requires a technical skill of welding so as not to cause the water break, and as a result, the manufacturing cost would be increased.

FIGS. 2 through 10 show examples of mechanism for forming the water film on the inner surface of the cylindrical body.

Figure 2:
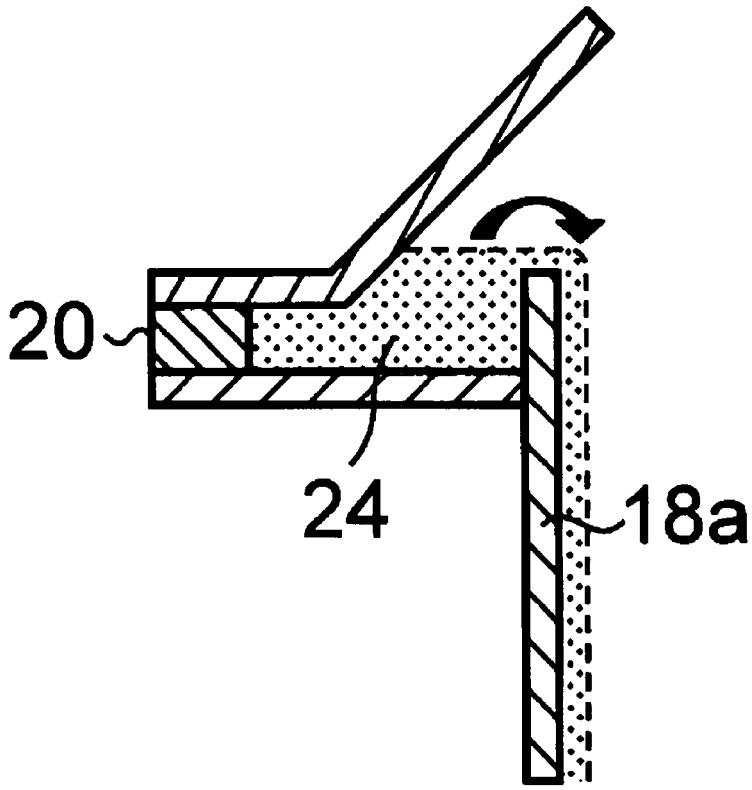
FIG. 2 is a cross-sectional view showing an example of a water-film formation mechanism.
Figure 3:
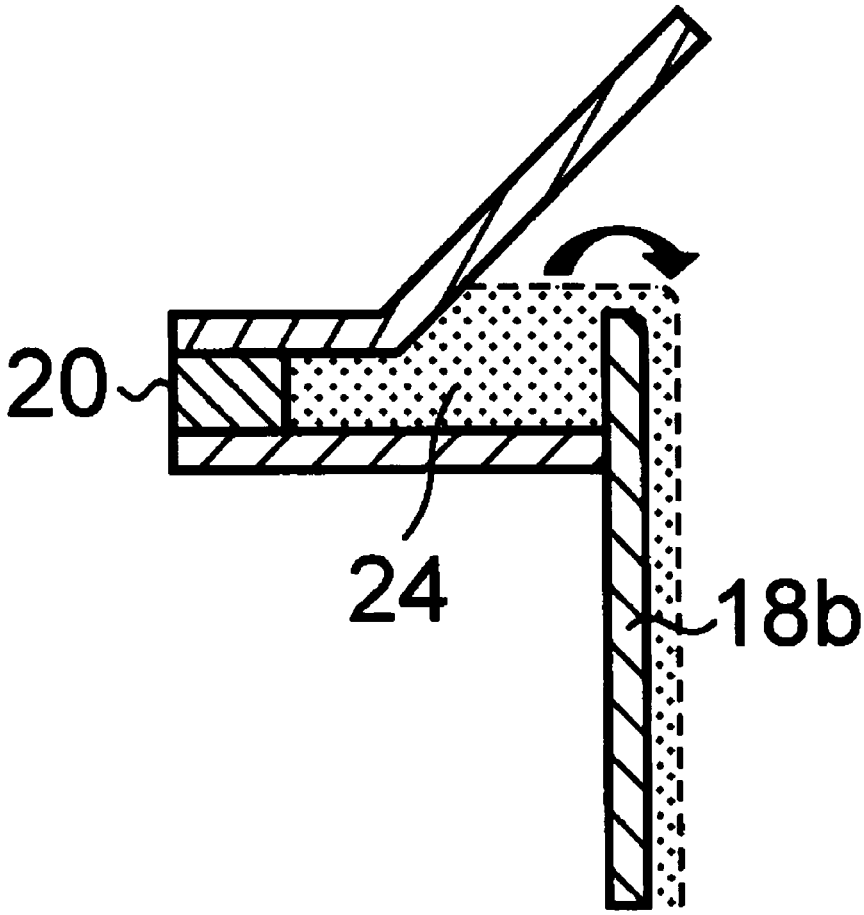
FIG. 3 is a cross-sectional view showing a modified example of the water-film formation mechanism.

FIG. 2 is a cross-sectional view showing an example of the water-flow flange (water-film formation mechanism) 20. This example of the water-film formation mechanism 20 comprises an annular water reservoir 24 and a weir 18*a*. The weir 18*a* forms part of the water reservoir 24. The weir 18*a* has a top portion with a uniform height. Therefore, a uniform water film with a uniform thickness can be formed on the inner surface of the cylindrical body 18. FIG. 3 shows a cylindrical weir 18*b* having a rounded inside top edge. The basic structure of this example of the water-film formation mechanism is the same as that in FIG. 2. This example can form a smooth flow of the water overflowing the weir 18*b*.

Figure 4:
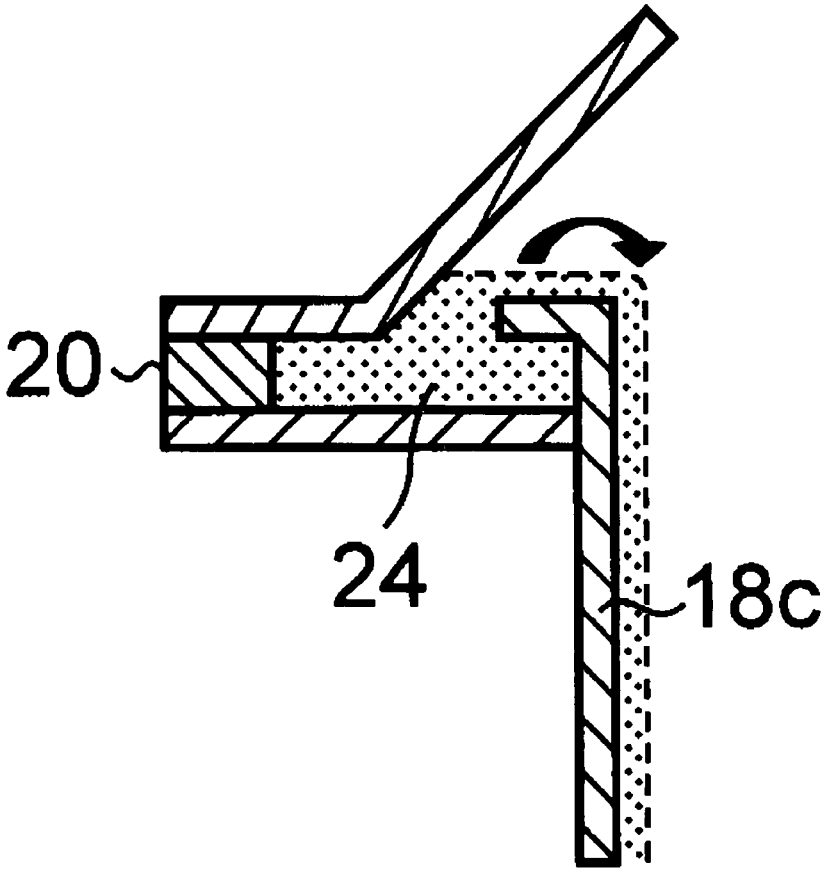
FIG. 4 is a cross-sectional view showing another modified example of the water-film formation mechanism.
Figure 5:
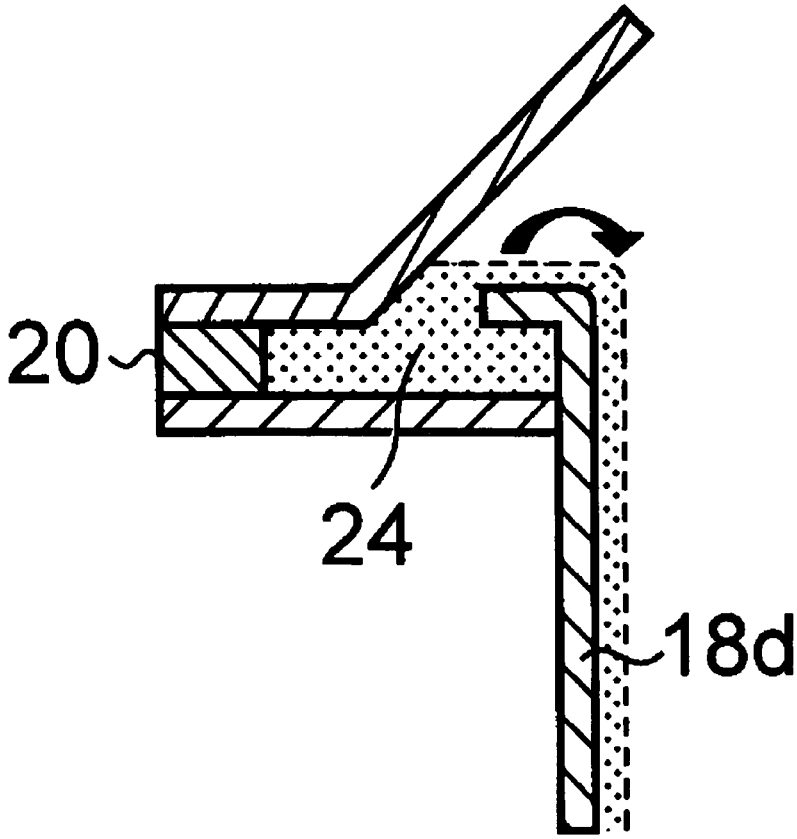
FIG. 5 is a cross-sectional view showing still another modified example of the water-film formation mechanism.
Figure 6:
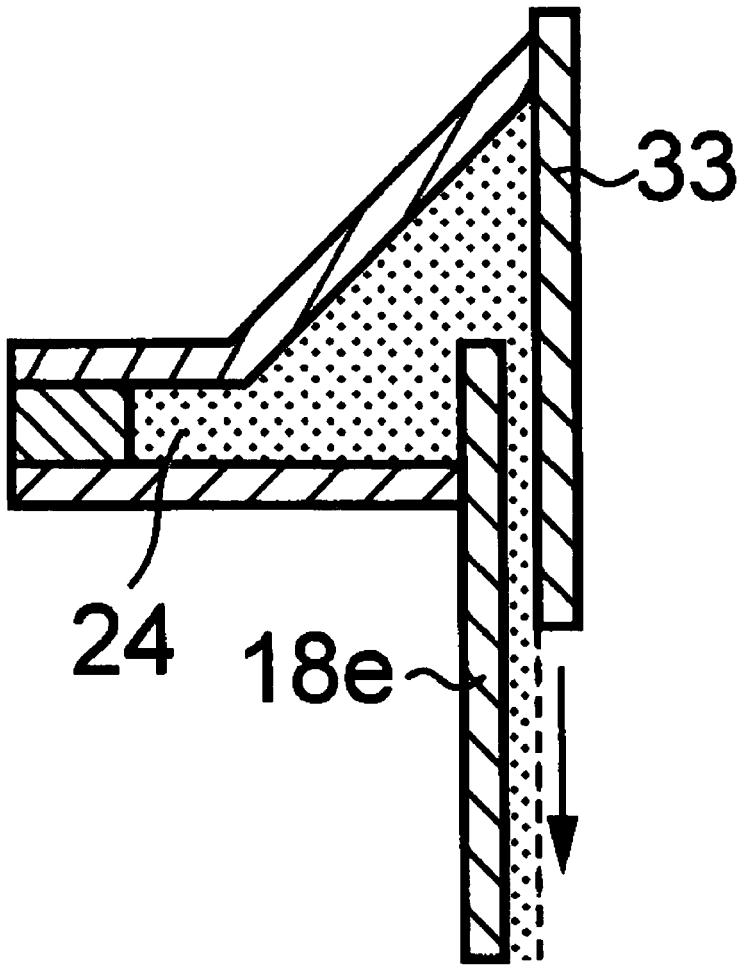
FIG. 6 is a cross-sectional view showing still another modified example of the water-film formation mechanism.

FIG. 4 is a modified example of FIG. 2, and shows a weir 18*c* having a top portion with a L-shaped cross section. This example of the water-film formation mechanism comprises annular water reservoir 24 and the weir 18*c*. The weir 18*c* forms part of the water reservoir 24. FIG. 5 shows a cylindrical weir 18*d* having a top portion with a L-shaped cross section and having a rounded inside top edge. The basic structure of this example of the water-film formation mechanism is the same as that in FIG. 4. FIG. 6 shows an example in which a cylindrical member 33 is provided radially inwardly of a cylindrical weir 18*e* and water flows down through a small gap between the weir 18*e* and the cylindrical member 33. This example of the water-film formation mechanism comprises annular water reservoir 24, the weir 18*e*, and the cylindrical member 33. The weir 18*e* forms part of the water reservoir 24.

Figure 7A:
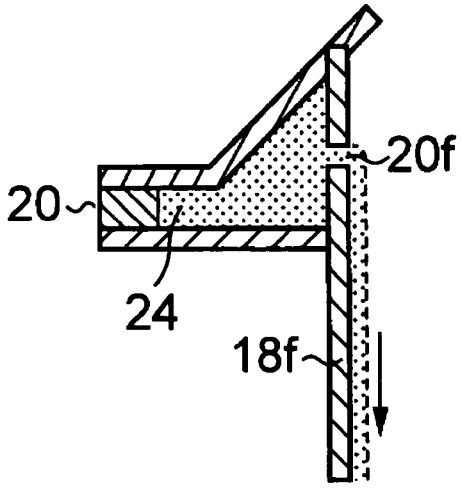
FIG. 7A is a cross-sectional view showing still another modified example of the water-film formation mechanism.
Figure 7B:
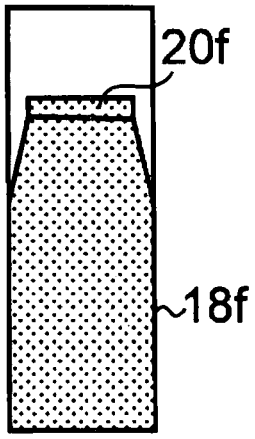
FIG. 7B is a front view of the water-film formation mechanism shown in FIG. 7A.
Figure 8A:
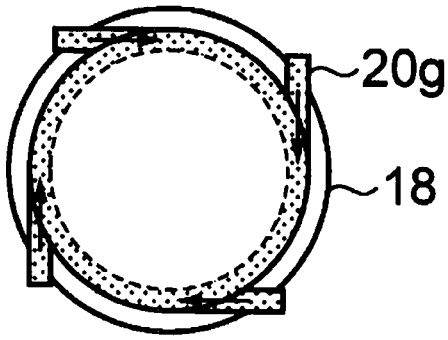
FIG. 8A is a plan view showing still another modified example of the water-film formation mechanism.
Figure 8B:
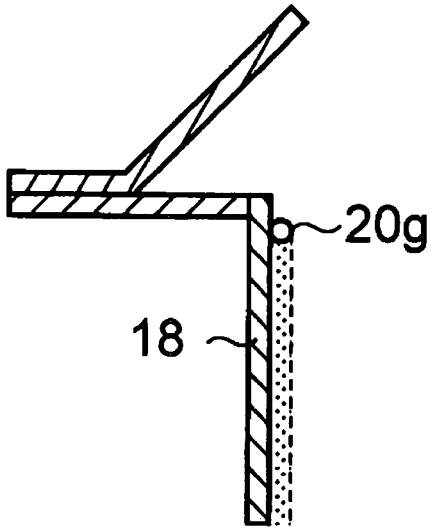
FIG. 8B is a cross-sectional view of the water-film formation mechanism shown in FIG. 8A.
Figure 9A:
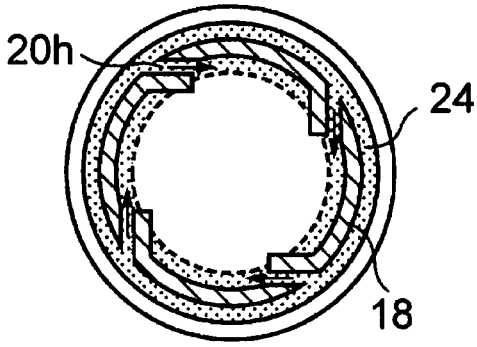
FIG. 9A is a plan view showing still another modified example of the water-film formation mechanism.
Figure 9B:
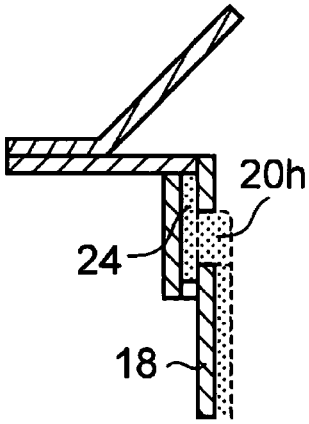
FIG. 9B is a cross-sectional view of the water-film formation mechanism shown in FIG. 9A.
Figure 9C:
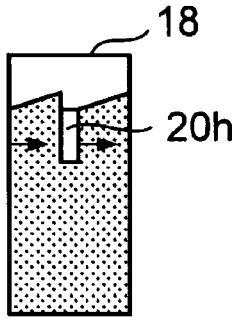
FIG. 9C is a front view of the water-film formation mechanism shown in FIG. 9A.

FIG. 7A and FIG. 7B show an example in which rectangular openings 20*f* are formed below a top portion of a cylindrical weir 18*f* such that water flows through the openings 20*f* to the inner surface of the cylindrical body 18. This example of the water-film formation mechanism comprises annular water reservoir 24, the weir 18*f*, and the rectangular openings 20*f* formed in the weir 18*f*. FIG. 8A and FIG. 8B show outlets 20*g* through which water flows out to form spiral flow on the inner circumferential surface of the cylindrical body 18. This example of the water-film formation mechanism comprises the plural outlets 20*g* formed in the inner surface of the cylindrical body 18. More specifically, the outlets 20*g* form the water flows in a horizontal direction along the inner circumferential surface of the cylindrical body 18. Because the plural outlets 20*g* are provided, a water film with a uniform thickness is formed on the inner circumferential surface of the cylindrical body 18. FIGS. 9A through 9C show outlets 20*h* through which water flows out to form spiral flow on the inner circumferential surface of the cylindrical body 18. This example of the water-film formation mechanism comprises annular water reservoir 24, and the vertically-elongated outlets 20*h* formed in the inner surface of the cylindrical body 18. Each of the outlets 20*h* has a rectangular shape whose one side is opened, so that the water flows out horizontally in the tangential direction to form the water film that covers the rectangular outlet 20*h* itself.

Figure 10A:
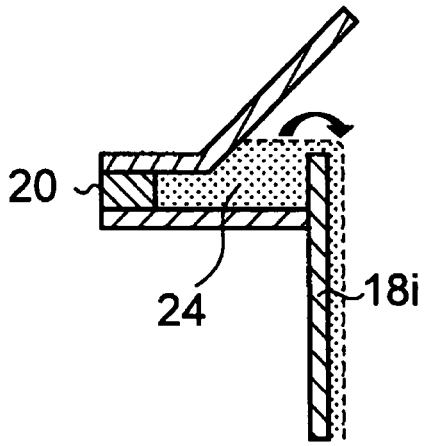
FIG. 10A is a cross-sectional view showing still another modified example of the water-film formation mechanism.
Figure 10B:
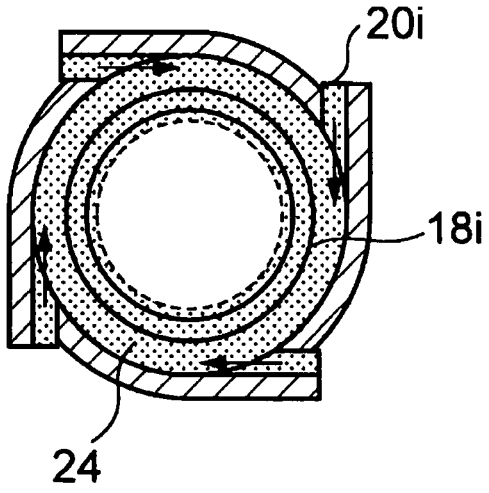
FIG. 10B is a plan view of the water-film formation mechanism shown in FIG. 10A.

FIG. 10A and FIG. 10B show an example in which water is supplied from a tangential direction into water reservoir 24 so as to form a swirling flow in the water reservoir 24 such that the water overflows the weir 18*i* to form spiral flow. This example of the water-film formation mechanism comprises the annular water reservoir 24, the weir 18*i*, and at least one supply port 20*i* for supplying the water from the tangential direction of the water reservoir 24 into the water reservoir 24. The weir 18*i* forms part of the water reservoir 24. When the water is supplied to the water reservoir 24 through the supply port 20*i*, the swirling flow of the water is formed in the water reservoir 24. As a result, a water level in the water reservoir 24 is uniformly increased throughout the circumferential direction thereof, and the water overflows the weir 18*i* uniformly onto the inner surface of the cylindrical body 18. One or more supply port 20*i* can be provided. Even if a single supply port 20*i* is provided, the swirling flow of the water can be formed in the water reservoir 24. Therefore, a uniform water film can be formed on the inner surface of the cylindrical body 18. According to this example, even if the cylindrical body 18 is inclined at a certain degree (for example, with a gradient such that height to length is 1 cm to 200 cm) from the horizontal direction due to installation conditions of the exhaust-gas treatment apparatus 10, a uniform water film can be formed stably.

Figure 11:
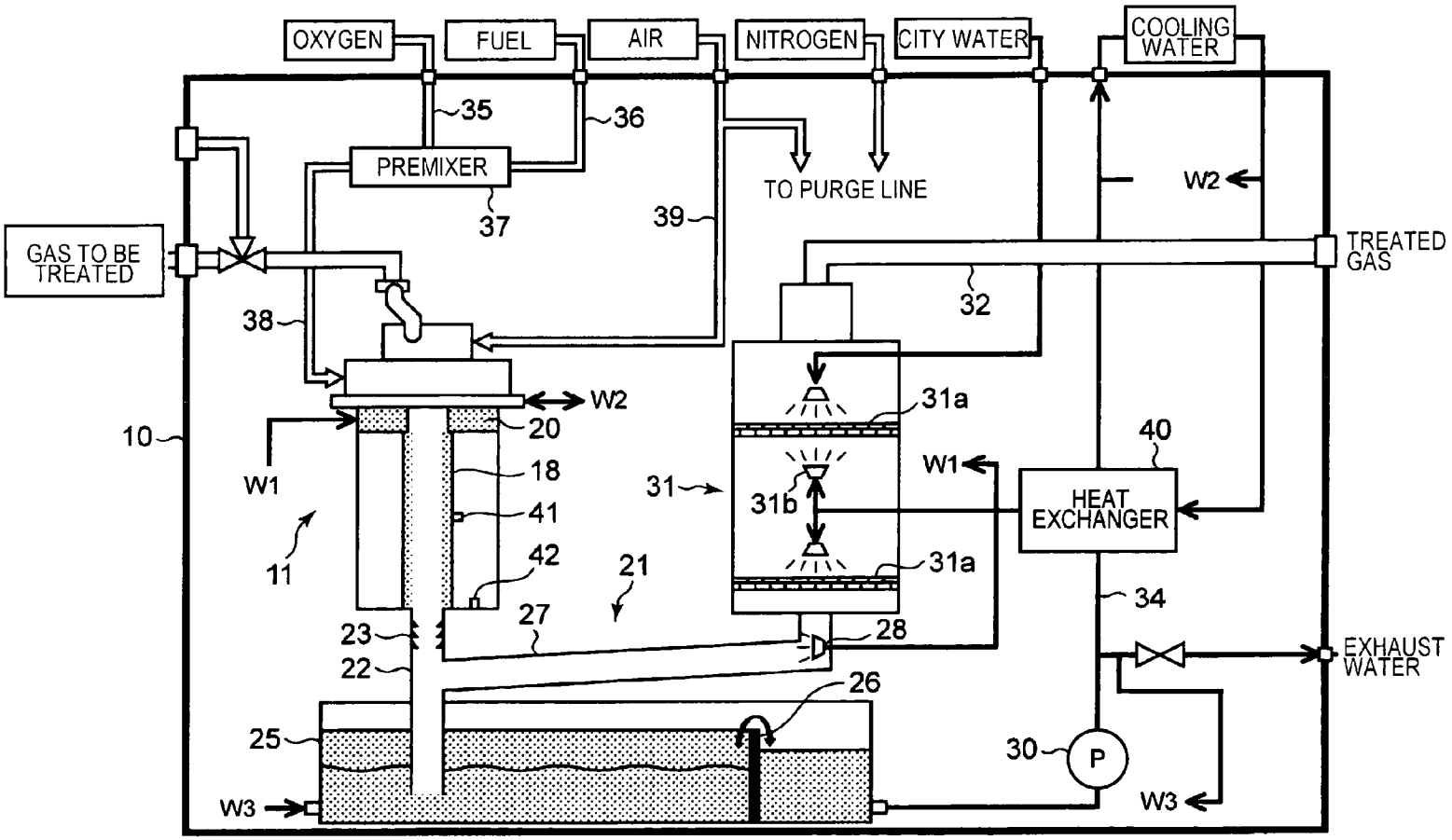
FIG. 11 is a block diagram showing a combustion-type exhaust gas treatment apparatus according to an embodiment of the present invention.

FIG. 11 is a whole structural example of the combustion-type exhaust gas treatment apparatus 10. Fuel and oxygen are supplied via pipes 35 and 36 to a premixer 37, where the fuel and the oxygen are mixed with each other to form a premixed fuel. This premixed fuel is supplied to the combustion treatment section 11 via a pipe 38. Air, which serves as an oxygen source for combusting (i.e., oxidizing) the exhaust gas, is supplied to the combustion treatment section 11 via a pipe 39.

The combustion-type exhaust gas treatment apparatus 10 comprises a cooling section 21 for cooling the exhaust gas that has been subjected to the combustion treatment, and a circulation tank 25 for storing and circulating the water which was used to form the water film A on the inner surface of the cylindrical body 18. The cooling section 21 is located downstream of the cylindrical body 18. The cooling section 21 comprises a pipe 22 which couples a lower end portion of the cylindrical body 18 and the circulation tank 25 to each other, and a pipe 27 which branches off the pipe 22 to a washing section 31. The pipe 27, which branches off the pipe 22, is inclined upwardly and is coupled to a lower end portion of the washing section (washing chamber) 31 via a vertical pipe. A water-spraying mechanism 28 for forming a water film on an inner surface of the pipe 27 is provided near a connection portion between the pipe 27 and the vertical pipe.

An inner surface of the pipe 22 is covered in its entirety with the water film which has flowed down from the cylindrical body 18, and the inner surface of the pipe 27 is covered in its entirety with the water film formed by the water-spraying mechanism 28. Because these water films serve as a heat-resisting material, temperatures of the pipes 22 and 27 can be kept at substantially ordinary temperature (not more than 50° C.), regardless of a high temperature of the exhaust gas which has been subjected to the combustion treatment. Moreover, the water films can prevent damages from the corrosive gas to the pipes. Therefore, a low-priced stainless steel can be used for the pipes 22 and 27. It has been a conventional measure to cover a surface of a gas-contact portion of a pipe made from metal, such as stainless steel, with a corrosion-resisting material (e.g., Teflon (registered trademark), or PVC) by chemical deposition, physical coating, painting or attachment. The structure according to the above-described embodiment of the present invention can eliminate the need to provide such a measure.

Figure 12A:
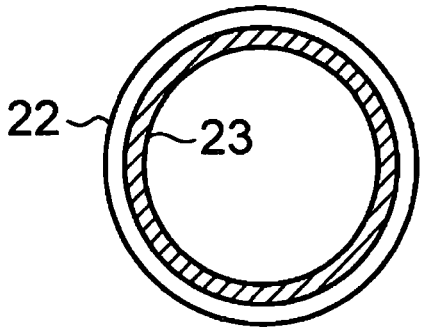
FIG. 12A is a plan view showing an example of a cooling-acceleration mechanism.
Figure 12B:
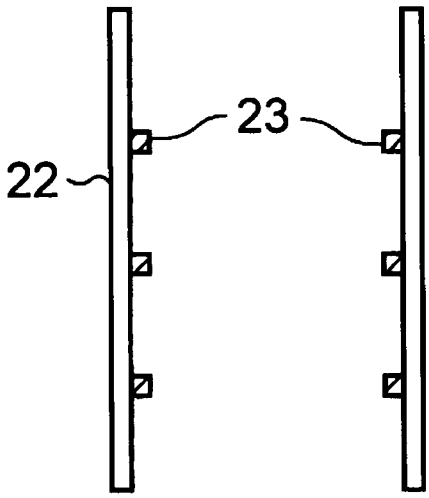
FIG. 12B is a cross-sectional view of the mechanism shown in FIG. 12A.
Figure 13A:
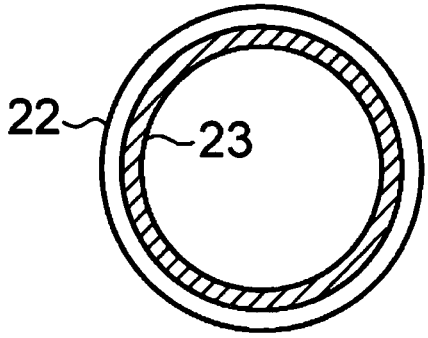
FIG. 13A is a plan view showing another example of the cooling-acceleration mechanism.
Figure 13B:
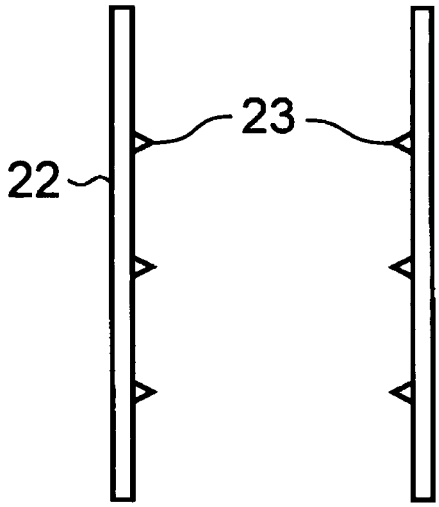
FIG. 13B is a cross-sectional view of the mechanism shown in FIG. 13A.
Figure 14A:
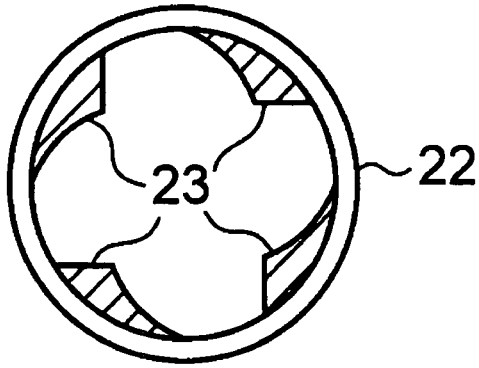
FIG. 14A is a plan view showing another example of the cooling-acceleration mechanism.
Figure 14B:
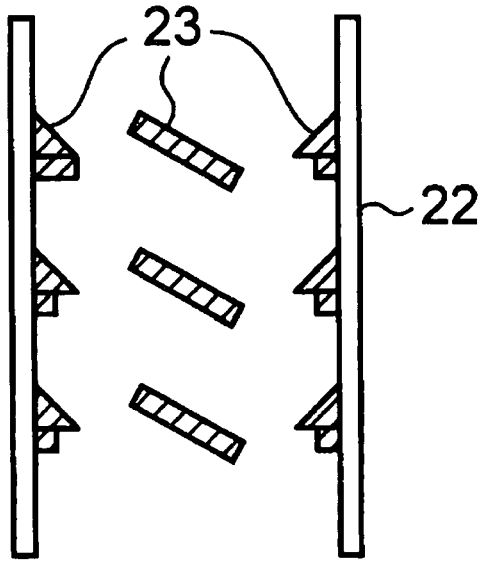
FIG. 14B is a cross-sectional view of the mechanism shown in FIG. 14A.
Figure 15A:
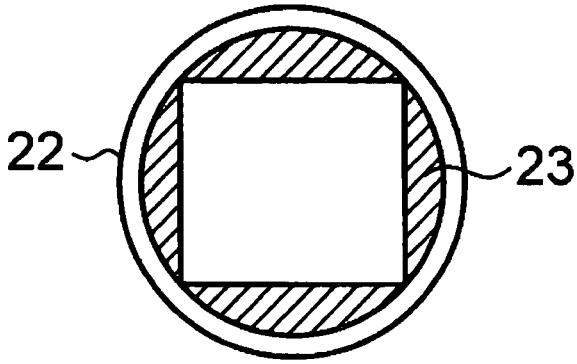
FIG. 15A is a plan view showing another example of the cooling-acceleration mechanism.
Figure 15B:
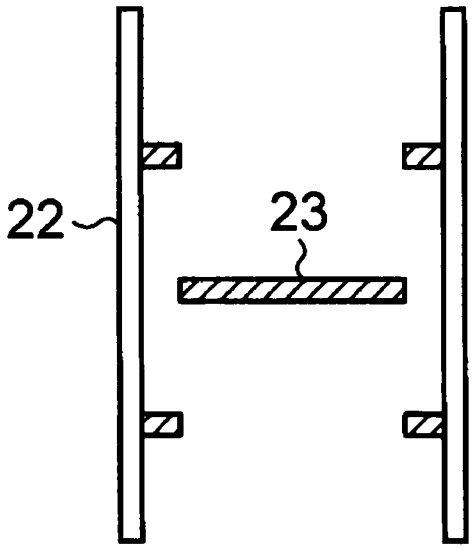
FIG. 15B is a cross-sectional view of the mechanism shown in FIG. 15A.
Figure 16A:
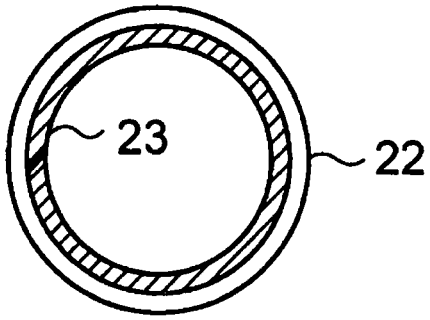
FIG. 16A is a plan view showing another example of the cooling-acceleration mechanism.
Figure 16B:
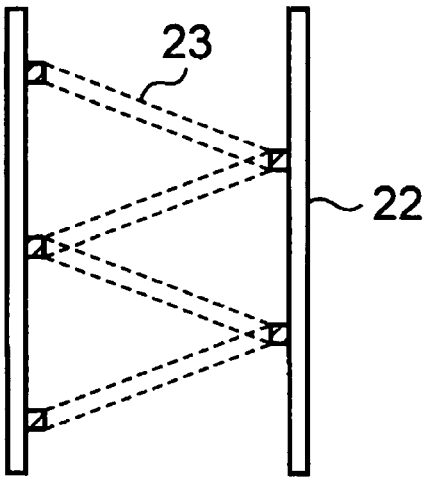
FIG. 16B is a cross-sectional view of the mechanism shown in FIG. 16A.

It is preferable to provide a cooling-acceleration mechanism, such as fin or baffle plate, on the inner surface of the pipe 22 or the pipe 27. FIGS. 12A, 12B through 16A, 16B show examples of the cooling-acceleration mechanism such as fin or baffle plate. FIG. 12A and FIG. 12B show ring-shaped fins 23 arranged on the inner surface of the pipe 22. FIG. 13A and FIG. 13B also show ring-shaped fins 23. The example shown in FIG. 13A and FIG. 13B is different from the example shown in FIG. 12A and FIG. 12B in that the fin 23 in FIG. 12A and FIG. 12B has a rectangular cross section and the fin 23 in FIG. 13A and FIG. 13B has a triangular cross section. FIG. 14A and FIG. 14B show short fins 23 inclined along the flowing direction of the exhaust gas in the pipe 22. FIG. 15A and FIG. 15B show semicircular baffle plates 23 provided on the inner surface of the pipe 22. Each of the semicircular baffle plates 23 is in such a shape as to fit a portion of the inner surface of the pipe 22. In the pipe 22, the baffle plates 23 are arranged at different vertical positions and different circumferential positions. The exhaust gas flows through the pipe 22 while contacting the inner surface of the pipe 22 and the baffle plates 23. In this manner, the cooling effect of the exhaust gas can be accelerated by the fins or baffle plates which are covered with the water film. FIG. 16A and FIG. 16B show a spiral fin 23 provided on the inner circumferential surface of the pipe 22.

The washing section 31 of the combustion-type exhaust gas treatment apparatus 10 comprises filters 31*a* and water-spraying mechanisms 31*b*. After the combustion treatment, the exhaust gas is cooled by the cooling section 21, and then introduced into the washing section 31. This washing section 31 washes the exhaust gas with water so as to capture and remove by-products including the dust and the oxidizing gas produced by the combustion treatment of the exhaust gas. The dust is removed by the filters 31*a*, and goes down with water sprayed from the water-spraying mechanisms 31*b*. The dust with the water flows through the pipes 27 and 22 into the circulation tank 25, and is stored in the tank 25. In this manner, the exhaust gas is rendered harmless by the combustion treatment, cooled in the cooling section 21, and washed with water in the washing section 31. The treated exhaust gas flows through a pipe 32 and is then released into the atmosphere or other space.

The circulation tank 25 has a weir 26 therein. After flowing down through the pipe 22, the water enters a chamber at a left side of the weir 26 as in the drawing. The water in the left chamber overflows the weir 26 into a chamber at a right side of the weir 26 as in the drawing. The water in the right chamber is sucked by a pump 30 and delivered to a heat exchanger 40 via a supply pipe 34. The heat exchanger 40 performs heat exchange between the water and cooling water so that the water has a suitable temperature. Thereafter, this water is reused as circulation water. The water, containing a large amount of dust, flows into the left chamber of the circulation tank 25. The dust is formed by particles, some of which have large diameters. Since the large particles are heavy, they sink to a bottom of the chamber. On the other hand, particles with very small diameters are lightweight, and thus overflow the weir 26 into the right chamber. The particles that were moved to the right chamber are mixed into the water that is to be used as the circulation water. The particles, mixed into the circulation water, may not have an adverse effect in use of the circulation water, so long as the particles have a diameter of about 50 μm. Accordingly, it is preferable that the weir 26 have a height such that particles with a diameter of more than 50 μm cannot overflow the weir 26.

After the temperature is adjusted in the heat exchanger 40, the water is supplied as water W1 to the water-flow flange 20. The water W1 is used to form the water film A on the inner surface of the cylindrical body 18, and to form the water film on the inner circumferential surface of the pipe 22. Then, the water is returned to the circulation tank 25. Part of the water, whose temperature has been adjusted in the heat exchanger 40, is supplied to the water-spraying mechanisms 31*b* of the washing sections 31, and is returned to the circulation tank 25. In addition, part of the water, whose temperature has been adjusted in the heat exchanger 40, is supplied to the water-spraying mechanism 28, which forms the water film on the inner circumferential surface of the pipe 22. Then, the water is returned to the circulation tank 25. In this manner, the water circulates. Therefore, the combustion-type exhaust gas treatment apparatus 10 has an advantage of requiring a very small amount of city water or industrial water for replenishment because most of the water used in operations of the apparatus 10 is the circulation water. Furthermore, because the water is reused as the circulation water, even if the water becomes a thin hydrofluoric acid after washing the exhaust gas, this acid is not expelled to the exterior of the apparatus 10.

Part of the cooling water to be supplied to the heat exchanger 40 is supplied as cooling water W2 to a non-illustrated cooling-water passage provided in the combustion treatment section 11. This water W2 serves to cool the exhaust-gas treatment combustor 12. Part of the water delivered by the pump 30 is supplied as water W3 to the circulation tank 25 so that the water W3 flows into the circulation tank 25 from a side portion of the circulation tank 25. The water, which has flowed into the circulation tank 25, sweeps away the by-products deposited on the bottom of the circulation tank 25 toward the weir 26, thereby preventing clogging of a lower end opening of the pipe 22 with the by-products.

The combustion-type exhaust gas treatment apparatus 10 comprises a temperature sensor 41 on the cylindrical body 18, and monitors an increase in temperature of the cylindrical body 18 with the temperature sensor 41. If the water break occurs on the inner surface of the cylindrical body 18, the heat resisting effect disappears at that portion. In such a case, the cylindrical body 18 is in direct contact with the high-temperature exhaust gas, which potentially causes damage to the inner surface of the cylindrical body 18. In order to detect such situations, the temperature sensor 41 is provided on the cylindrical body 18 so as to secure the safety.

A leak sensor 42 is provided on a portion that serves as a saucer of the cylindrical body 18. If the cylindrical body 18 is damaged and a through-hole is formed, the leak sensor 42 can detect the presence of such a through-hole. In this manner, providing the leak sensor 42 can improve the safety.

Although certain preferred embodiments of the present invention have been described, it should be understood that the present invention is not limited to the embodiments described above, and various changes and modifications may be made without departing from the scope of the present invention.

What is claimed is:

1. A combustion-type exhaust gas treatment apparatus, comprising:

a circulation tank;

a weir disposed in said circulation tank;

a combustion treatment section for performing combustion treatment on an exhaust gas; and a cooling section for cooling the exhaust gas which has been treated in said combustion treatment section, wherein said combustion treatment section includes an exhaust-gas treatment combustor configured to form flames, a cylindrical body made from metal and arranged below said exhaust-gas treatment combustor, said cylindrical body being located downstream of the flames, an annular water reservoir provided between said exhaust-gas treatment combustor and said cylindrical body, and a water-film formation mechanism configured to form a swirling water film on an inner surface of said cylindrical body, said water-film formation mechanism having at least one water supply port that supplies water into said annular water reservoir in a direction tangential to said annular water reservoir, and wherein said circulation tank is located below said cylindrical body and is configured to receive the water that formed the swirling water film on said inner surface of said cylindrical body, wherein said weir is configured to prevent circulation of by-products having a predetermined size which are contained in the water, and wherein said inner surface of said cylindrical body is roughened.

2. The combustion-type exhaust gas treatment apparatus according to claim 1, wherein said inner surface of said cylindrical body has a diameter being constant from an upper end to a lower end of said cylindrical body.

3. The combustion-type exhaust gas treatment apparatus according to claim 1, wherein said inner surface of said cylindrical body has a diameter being gradually reduced in size from an upper end to a lower end of said cylindrical body.

4. The combustion-type exhaust gas treatment apparatus according to claim 1, wherein said circulation tank is coupled to said cooling section.

5. The combustion-type exhaust gas treatment apparatus according to claim 4, further comprising a washing section for washing the exhaust gas with water so as to remove by-products produced by the combustion treatment, wherein said cooling section comprises:

a first pipe configured to couple a lower end of said cylindrical body and said circulation tank to each other;

a second pipe branching off said first pipe to said washing section; and mechanisms adapted to form water films on inner surfaces of said first pipe and said second pipe.

6. The combustion-type exhaust gas treatment apparatus according to claim 5, wherein:

said second pipe is inclined upwardly from a portion where said second pipe branches off said first pipe; and a water-spraying mechanism is provided for spraying water toward said inner surface of said second pipe.

7. The combustion-type exhaust gas treatment apparatus according to claim 5, further comprising:

a fin or baffle plate provided on said inner surface of said first pipe or said second pipe.

8. The combustion-type exhaust gas treatment apparatus according to claim 4, further comprising:

a washing section for washing the exhaust gas with water so as to remove by-products produced by the combustion treatment, a supply pipe and a pump for supplying water stored in said circulation tank to said water-film formation mechanism, said washing section, and said cooling section; and a heat exchanger coupled to said supply pipe.

9. The combustion-type exhaust gas treatment apparatus according to claim 8, wherein the water, which has been supplied to said water-film formation mechanism and said washing section, is returned to said circulation tank via said cooling section.

10. The combustion-type exhaust gas treatment apparatus according to claim 1, further comprising: a temperature sensor provided on said cylindrical body, said temperature sensor being for detecting an increase in temperature of said cylindrical body.

11. The combustion-type exhaust gas treatment apparatus according to claim 1, further comprising: a leak sensor for detecting leakage of the water from said cylindrical body.

12. The combustion-type exhaust gas treatment apparatus according to claim 1, wherein said cylindrical body is made of stainless steel.

13. The combustion-type exhaust gas treatment apparatus according to claim 1, wherein said water-film formation mechanism is configured to form the swirling water film with a uniform thickness of at least 2 mm.

14. The combustion-type exhaust gas treatment apparatus according to claim 1, wherein said annular water reservoir is arranged radially outwardly of said cylindrical body.

15. The combustion-type exhaust gas treatment apparatus according to claim 1, wherein said annular water reservoir is arranged radially outwardly of said cylindrical body, and positioned at a top end of said cylindrical body closest to said exhaust-gas treatment combustor.

16. The combustion-type exhaust gas treatment apparatus according to claim 1, wherein said annular water reservoir has a water outlet supplying water to said inner surface of said cylindrical body, said water outlet being disposed downstream of said exhaust-gas treatment combustor.

17. The combustion-type exhaust gas treatment apparatus according to claim 1, wherein said annular water reservoir has a water outlet supplying water to said inner surface of said cylindrical body, said water outlet being disposed downstream of said exhaust-gas treatment combustor and downstream of the flames.

* * * * *